US005733158A

United States Patent [19]

Higginbotham et al.

[11] Patent Number: 5,733,158

[45] Date of Patent: Mar. 31, 1998

[54] INFLATABLE REVERSIBLE LIFE RAFT

[75] Inventors: Paul Higginbotham, Richmond; Sang A. Lay, Surrey, both of Canada

[73] Assignee: Dunlop-Beaufort Canada Ltd., Richmond, Canada

[21] Appl. No.: 746,419

[22] Filed: Nov. 12, 1996

[51] Int. Cl.[6] ..... B63B 35/58

[52] U.S. Cl. ..... 441/38; 441/40

[58] Field of Search ..... 441/37–41

[56] References Cited

U.S. PATENT DOCUMENTS

| | | | |
|---|---|---|---|
| 3,123,843 | 3/1964 | Tangen | 441/38 |
| 3,574,875 | 4/1971 | Tulett | 441/38 |

FOREIGN PATENT DOCUMENTS

| | | | |
|---|---|---|---|
| 839716 | 6/1960 | United Kingdom | 441/38 |

*Primary Examiner*—Sherman Basinger
*Attorney, Agent, or Firm*—Adrian Zahl

[57] ABSTRACT

An inflatable life raft incorporates upper and lower canopies that are raised automatically above the upper or lower sides of the raft, respectively, depending on which side of the raft is facing upwardly when the raft is floating. The canopies each form a tent-like enclosure when raised to protect the raft occupants. The canopies are selectively raised by a generally vertically-oriented pillar slideably joined to the raft body, each end of the pillar being joined to corresponding upper and lower canopies. Preferably, the pillar is capable of floating to permit it to elevate above the raft body. The pillar may comprise an inflatable elongate member that slides disposed within an aperture within the floor. A skirt joins the pillar to the floor and provides a reversible waterproof seal between the pillar and the floor and limits the range of vertical travel of the pillar. One or more drain holes may be provided within the base of the skirt to allow the occupants to drain water from within the raft. A fabric cover protects the drain holes, and may be drawn up around the pillar after the water has been drained to prevent water from entering the raft. The raft may also incorporate but a single canopy on one side of the raft, for use in calmer waters where accidental inversion of the raft is unlikely.

10 Claims, 3 Drawing Sheets

INFLATABLE REVERSIBLE LIFE RAFT

FIELD OF THE INVENTION

The invention relates to an emergency-use life raft having an enclosure to protect occupants against the elements, with dual canopy structures on either side of the raft to provide a protective tent-like enclosure regardless of which side of the raft faces upwardly.

BACKGROUND OF THE INVENTION

It is desirable to provide in an emergency-use life raft a canopy to protect the occupants against exposure to the elements. Typically, such rafts have a tent-like enclosure that fully covers the raft and provides a sheltered interior space. Such rafts are typically of the inflatable type and may be either stored in the inflated configuration or provided with self-inflating means such as gas canisters within or attached to the air chambers that release upon immersion in seawater or upon manual release by a user.

A drawback of the conventional type of canopy-covered raft is that if the raft flips or inflates upside down, as may easily happen in stormy seas or if the raft is dragged down by the sinking ship before the occupants have a chance to enter the raft, the canopy will be on the underside of the raft and the advantage of the canopy will be lost. In this situation, it is usually extremely difficult for users to invert the raft and they are thus required to climb onto the bottom side of the raft. The results of this have become tragically evident in at least one recent ferry disaster in a northern climate, when life rafts were shown to have been properly inflated and deployed, but at least several rafts became inverted in high seas. Survivors of the wreck were forced to board the upside-down rafts and many perished from exposure to the elements before they could be rescued.

This problem has been addressed by a self-righting means in a canopy-covered raft. For example, U.S. Pat. No. 4,998,900 (Wright) employs an inflatable tubular structure extending above the raft, intended to prevent the raft from inverting when it is fully inflated. A drawback to this approach is the need to provide a superstructure that comprises a relatively complex arrangement of inflatable tubing. This structure is expensive and potentially subject to leakage and tears. This type of raft could still invert in sufficiently stormy seas, and the users would still be faced with an inverted raft lacking a usable protective canopy. As well, a large superstructure might tend to catch the wind, resulting in undesired instability and movement of the raft.

Another approach to the problem, and the one taken by the present invention, is to provide a means whereby the raft is reversible and incorporates a dual canopy structure, such that regardless of the side of the raft that faces upwardly, a canopy may be extended above the raft. This results in a simple and relatively inexpensive design that does not rely on a complex superstructure extending above the raft. The resulting raft is indifferent to inversion. Once the raft is occupied, the weight of the occupants renders accidental inversion unlikely.

It is also desirable to provide a simple means whereby the canopy is automatically raised above the raft upon entry of the raft into the water. This means may be adapted for use in a raft having but a single canopy, for use in calmer waters, but where it is still desired to provide an automatic means to elevate the canopy upon entry of the raft into the water.

The raft of the type contemplated in the present invention may comprise an inflatable fabric raft with a generally rectangular or other configuration The main raft body may be similar to a conventional inflatable life raft in having one or more inflatable tubes comprising a sidewall structure extending around the perimeter of the raft, and a floor stretched across the interior of the raft.

OBJECTS OF THE INVENTION

The present invention has as an object the provision of an emergency inflatable life raft, with means to extend a canopy above whichever side of the raft is facing upwardly. It is a further object of the invention to provide an emergency raft wherein the canopy is automatically raised above the body of the raft for protection of the occupants.

SUMMARY OF THE INVENTION

The present invention, in its first preferred embodiment, is an emergency life raft comprising a raft body and upper and lower canopies on either side of the raft body. The raft body is comprised of a sidewall and a floor spanning the interior of the raft body. The floor is attached to the sidewall approximately midway up the sidewall, and defines upper and lower sidewall portions on either side of the floor. The raft body has upper and lower interior regions, defined by sidewall portions extending above and below the floor, respectively, to provide a useable interior space regardless of which side of the raft faces upwardly. A generally vertically-oriented pillar is slideably joined to the raft body and has elevation means to elevate a portion of the pillar above the raft body when the raft is floating. The upper and lower canopies are selectively supported by corresponding upper and lower ends of the pillar. When the raft is upright, the upper canopy is supported by the pillar to form a tent-like enclosure. The lower canopy in like manner forms a tent-like enclosure when the raft is inverted. The pillar is maintained in its upright position by an even tension exerted on all sides of the pillar by the canopy.

In a preferred version, the elevation means of the pillar consists of flotation means to float the pillar such that a portion of the pillar extends above the raft body. The pillar comprises an inflatable elongate member that is slideably disposed within an aperture within the floor, with the flotation of the pillar itself defining the flotation means. A skirt joins the pillar to the floor and serves to provide a waterproof seal between the pillar and the floor and to limit the range of vertical travel of the pillar. One or more drain holes may be provided around the base of the skirt to allow the occupants to drain water from within the raft. A fabric cover protects the drain holes, and may be drawn up the pillar after the water has been drained to prevent water from entering the raft. The raft sidewall preferably comprises upper and lower inflatable buoyancy tubes. The upper and lower canopies each have an opening to permit the entry of occupants into the raft interior, and for water to enter the lower canopy to serve as ballast.

In a second embodiment of the invention, the raft has but a single canopy structure on a single, upper, side of the raft, and canopy elevation means are provided to automatically elevate the canopy above the raft body upon entry of the raft into water. In this version, the raft body may be of the conventional type with an interior, defined by sidewalls extending above the floor, on but one side of the raft. The canopy elevation means consists of a slideably-disposed pillar as in the first embodiment, but which is adapted to elevate but a single canopy on one side of the raft.

DETAILED DESCRIPTION OF THE PREFERRED EMBODIMENT

Figure 1:
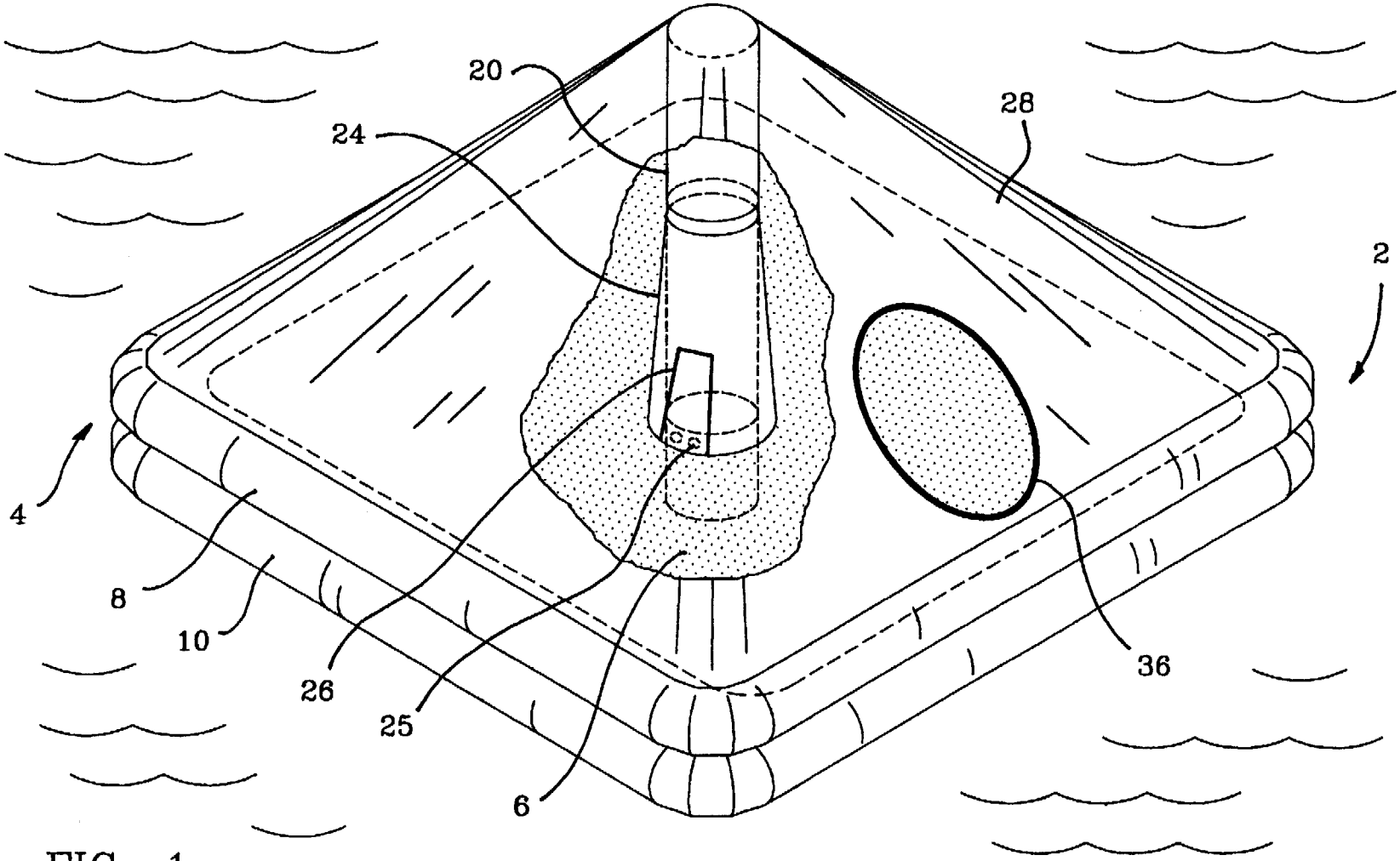
FIG. 1 is a perspective view a life raft according to the present invention, shown partly cut away.
Figure 2:
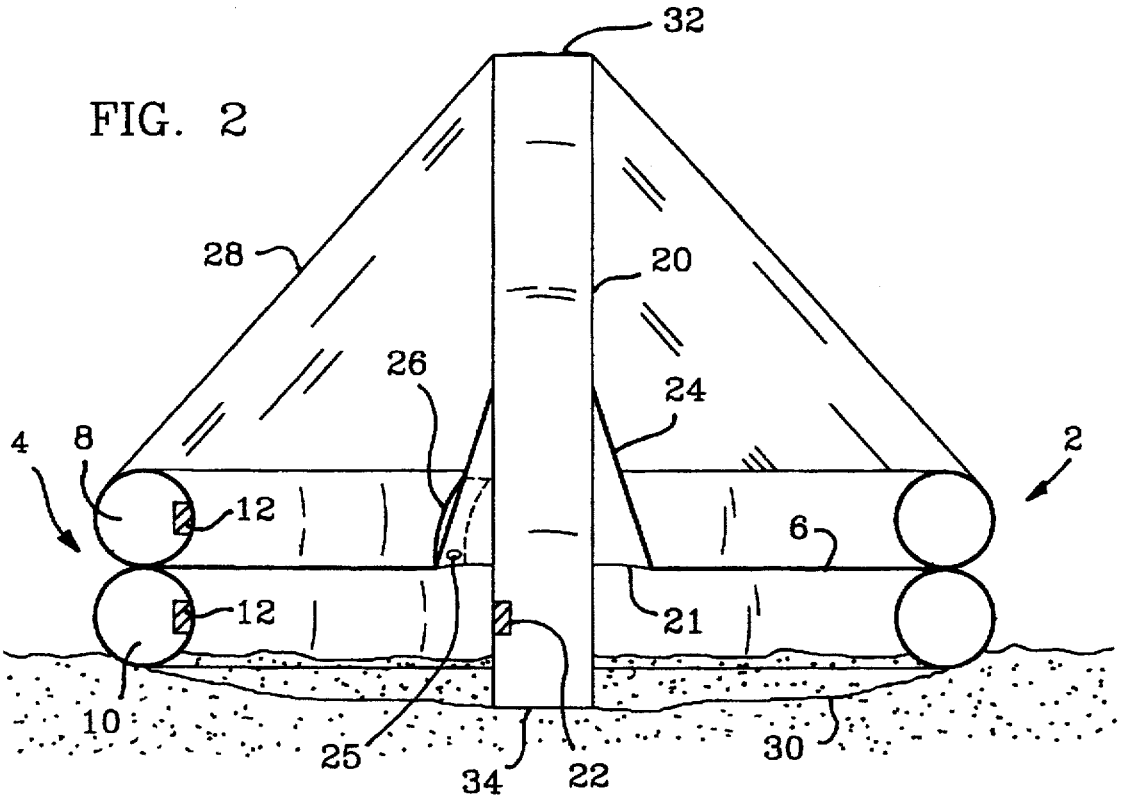
FIG. 2 is a side elevational view of the invention.

Turning to the first embodiment and referring to FIGS. 1 and 2, a raft body 2 has a generally rectangular footprint and comprises an inflatable sidewall 4 extending about the raft perimeter and a floor 6 stretched across the interior of the raft. The sidewall comprises upper and lower fabric buoyancy tubes 8 and 10. The raft, which is vertically symmetrical and reversible in the upper and lower directions, is described herein with reference to "upper" and "lower" aspects. It will be understood that these terms are used for reference only, and either side of the raft may comprise the upper side. It will also be understood that although the raft body of the embodiment described and illustrated herein has a rectangular configuration, the raft body may take any suitable shape. As well, the raft body need not be of the inflatable type, but may comprise a rigid structure.

The buoyancy tubes of the raft body are each provided with a pressurized gas canister 12 within its interior for automatic inflation. The cylinder includes a conventional activation means, not shown, that permits the cylinder to release the pressurized gas (typically carbon dioxide) upon immersion in sea water or upon manual activation. Prior to release of the gas from the canister, the entire device may be stored in a rolled or bunched form or the like.

The raft floor 6 comprises a flexible waterproof sheet extending across the interior of the raft body. The floor is fastened to the sidewall with a waterproof fastening means about midway up the sidewall and between the upper and lower buoyancy tubes. When the sidewall is fully inflated, the floor stretches tightly across the interior of the raft, with a generally equal height of sidewall extending above and below the floor. In this manner, regardless of which side of the raft is facing upwardly, the raft will have an interior defined by a portion of the sidewall extending above the floor.

A central inflatable pillar 20 is slideably disposed within an aperture 21 within the floor and is oriented generally vertically when the raft is floating, as seen in FIGS. 1 and 2. The pillar is provided with elevation means to maintain a portion of the pillar elevated above the raft body. The elevation means here comprise flotation means, provided by flotation of the pillar itself, to float the pillar when the raft is within the water. Preferably, the pillar is provided with a gas canister 22 for automatic inflation. Alternatively, the pillar may be filled by transferring gas from either of the buoyancy tubes. A waterproof skirt 24 connects the floor 6 to the pillar. The skirt provides a waterproof seal between the pillar and the floor and limits the range of motion of the pillar in a vertical direction relative to the floor. When the raft is floating, the pillar floats upwardly and draws the skirt upwardly, to the upper limit permitted by the skirt. In this position, the greater part of the pillar extends upwardly above the floor, with a lower portion of the pillar being biased upwardly by flotation. Upon inversion of the raft, the pillar reverses its orientation and the skirt inverts and similarly limits travel of the pillar 20.

The skirt is provided with one or more drain holes 25 where the skirt meets the floor. The drain holes are protected by a waterproof cover 26 that may be extended upwardly above the holes and prevent water from entering the raft. The cover is provided with velcro (tm.) or other fastening means at its upper edge for attachment to the skirt or the pillar. When the cover is released and pulled down, the drain holes are exposed and permit water that may have entered the raft to drain out from the interior of the raft. After the water is drained, the holes are protected by extending the cover upwardly and fastening it to the skirt. The cover inverts through the aperture 21 along with the skirt upon inversion of the raft.

Upper and lower fabric canopies 28 and 30, respectively, extend across the upper and lower sides of the raft body. Each canopy is fixed along its edges to a corresponding buoyancy tube, and is capable of forming a tent-like enclosure when elevated. The upper and lower ends 32 and 34, respectively, of the pillar 20 are each fastened to the middle of respective canopies. Once the pillar is inflated, its flotation automatically raises the upper canopy. When the raft is floating in the upright position of FIG. 1, the pillar acts like a tent pole to elevate the upper canopy above the raft body to form a tent-like enclosure. The even tension of the fabric on all sides of the pillar and the skirt 24 retain the pillar in a generally vertical position. An entrance hole 36 within the canopy permits occupants to enter and exit the raft. The lower canopy, which hangs loosely below the raft, fills at least partly with water when the raft is floating to serve as ballast to assist in keeping the raft upright.

In the event the raft inverts before it can be occupied, as shown in the sequence in FIGS. 3(*a*)–(*d*), the lower canopy will be positioned on what is now the upper side of the raft. The pillar 20 floats upwardly and slides through the aperture within the floor upon inversion of the raft, as seen in FIG. 3(*c*), and the previous lower canopy 30 is elevated to form a tent-like enclosure above the raft body. The canopy 28 that previously comprised the upper canopy becomes the lower canopy.

Emergency supplies and equipment may be provided in waterproof compartments, not shown, on both the upper and lower sides of the raft.

Figure 4:
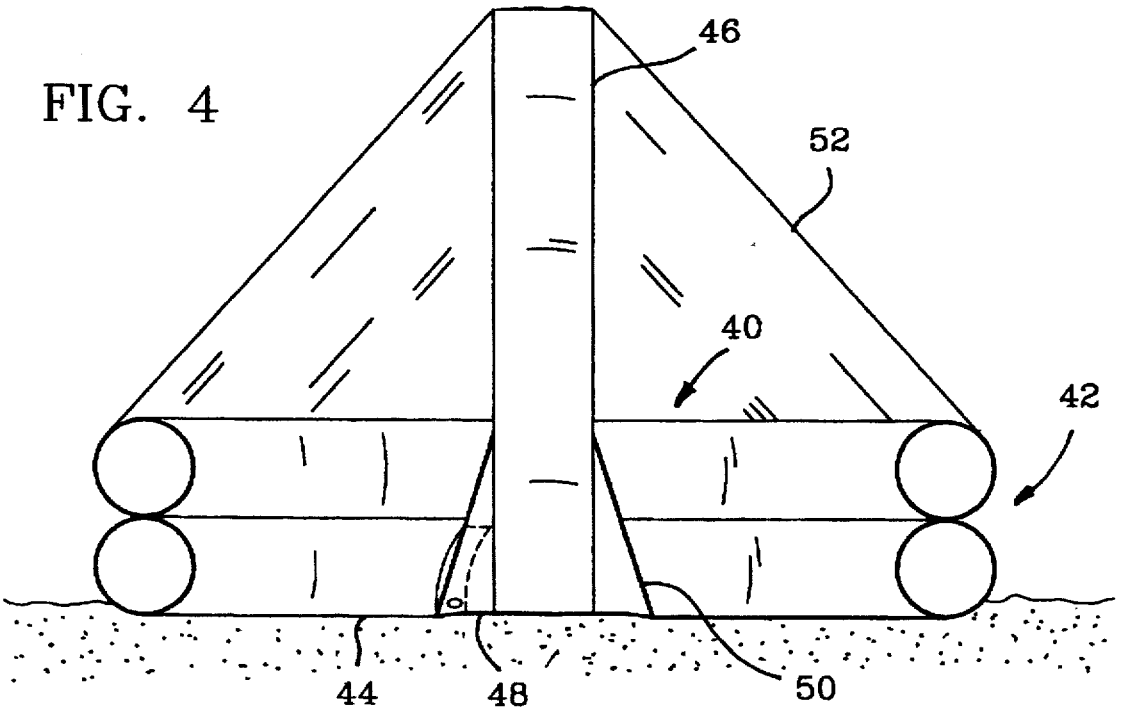
FIG. 4 is a side elevational view of a second embodiment of the invention.
Figure 3B:
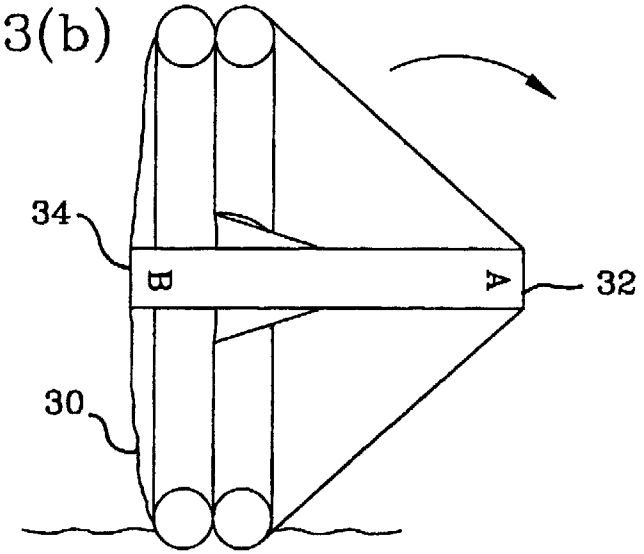
FIGS. 3(*a*)–(*d*) are side elevational views of the invention, showing an inversion sequence.
Figure 3D:
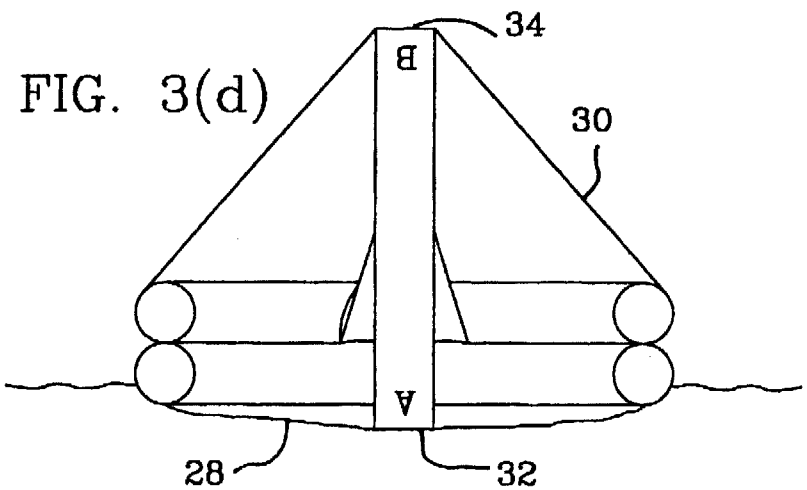
Figure 3A:
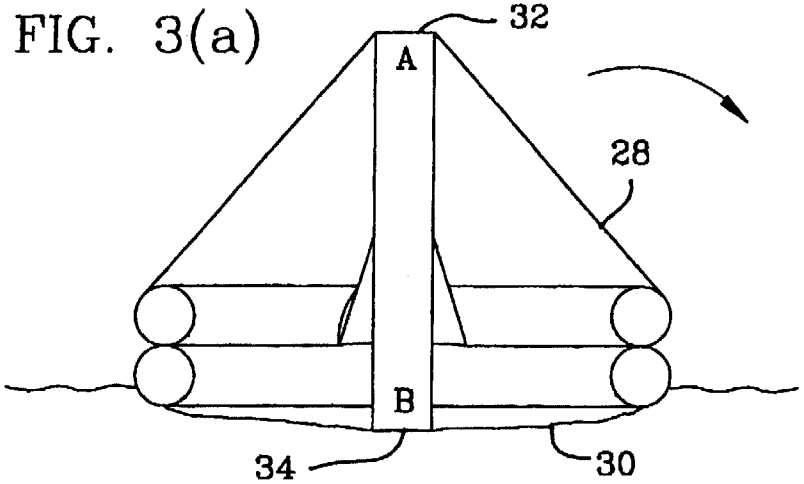
Figure 3C:
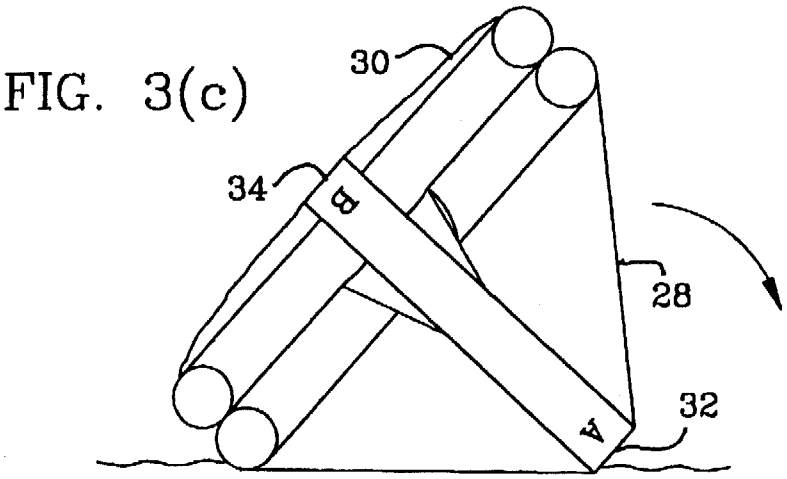

A second embodiment, seen in FIG. 4, is intended for use in calmer waters where inversion of the raft is not expected and it is desired to provide an enclosed raft with automatic canopy-raising means. The raft body 40 in this version has a similar inflatable sidewall 42. While it is possible to use but a single inflatable chamber for the sidewall, dual buoyancy tubes are used for safety. A floor 44 is stretched across the raft body near the bottom of the sidewall. An inflatable central pillar 46 is slideably disposed within an aperture 48 within the floor, as in the first embodiment, and is joined to the floor by means of a skirt 50. A canopy 52 extends across the upper side of the raft body, and is joined to the upper end of the pillar 46. As in the first embodiment, the sidewall and pillar may comprise inflatable members, and may be provided with gas canisters, not shown, for automatic inflation. Upon entry of the boat into water, and inflation of all members, the pillar floats upwardly and supports the canopy in the tent-like configuration shown in FIG. 4.

It will be seen that although the invention has been described by way of a preferred embodiment thereof, numerous departures from and variants of the described embodiment may be made without departing from the spirit and scope of the invention, as defined by the appended claims.

We claim:

1. A life raft comprising:

a) a raft body capable of floatation in either a normal upright position or an inverted position, said raft body comprising a sidewall and a floor spanning the interior of the raft body fixed to said sidewall at a position partway up said sidewall so as to define upper and lower sidewall portions on either side of the floor and to provide upper and lower raft interiors defined by sidewall portions extending above and below, respectively, said floor;

b) a generally vertically-oriented pillar joined to said raft body by way of slidable engagement means that permit said pillar to slide vertically relative to said raft body to permit the orientation of the pillar to reverse and to permit a portion of said pillar to extend upwardly above said raft body when said raft body is floating in either said normal or said inverted position, said pillar having elevation means to elevate a portion of said pillar above said raft body when said raft is floating;

c) reversible restraining means engaged to said pillar and said raft body to limit the upward travel of said pillar relative to said raft body, said reversible restraining means adapted to restrain said pillar in either of said normal or said inverted positions; and d) upper and lower canopies fastened to the raft body, said upper canopy being supported by said pillar-to form a tent-like enclosure when said raft body is floating in an upright position and said lower canopy in like manner forming a like tent-like enclosure when said raft is inverted.

2. A raft as in claim 1, wherein said slidable engagement means comprises an aperture within said floor shaped to permit said pillar to slide therethrough and extend upwardly above said floor, and sealing means are provided between the pillar and the floor to prevent leakage of water between said pillar and said raft body.

3. A raft as in claim 2, wherein said restraining means and comprises an invertible skirt joining the pillar to said floor and adapted to limit the range of vertical travel of said pillar.

4. A raft as in claim 3, wherein there is further provided one or more drain holes through said skirt, said drain holes being protected against unwanted entry of water by a cover fastenable to said skirt or said pillar.

5. A raft as in claim 2, wherein said aperture is generally centrally disposed within said floor.

6. A raft as in claim 1, wherein said pillar comprises an inflatable floatable member, the flotation of said pillar when said raft is floating comprising said elevation means, and said elevation means are activated upon entry of the raft into water to erect said tent-like enclosure automatically.

7. A raft as in claim 1, wherein said sidewall comprises upper and lower inflatable buoyancy tubes extending at least partway around the periphery of said raft body.

8. A raft as in claim 1, wherein said upper and lower canopies each have an opening therein to permit, respectively, the entry of occupants into the raft interior, and water into the lower canopy to serve as ballast.

9. A raft as in claim 1, wherein said pillar is maintained in a generally vertical position by generally even tension exerted by the upper or lower canopy upon all sides of said pillar.

10. A life raft comprising a raft body having a sidewall and a floor spanning the interior of the raft body; a generally vertically-oriented pillar joined to said raft body by way of slidable engagement means that permit said pillar to slide vertically relative to said raft body to permit a portion of said pillar to extend upwardly above said raft body, said pillar having elevation means to elevate a portion of said pillar above said raft body upon entry of the raft into water; restraining means engaged to said pillar and said raft body to limit the upward travel of said pillar relative to said raft body, said restraining means comprising a skirt joining the pillar to said floor, said skirt having one or more drain holes therethrough, a canopy fastened to said raft body and being supported by said pillar to form a tent-like enclosure when said raft is floating, and a cover fastenable to said skirt or said pillar to cover said drain holes and restrict the entry of water into the raft.

* * * * *